US006728506B2

(12) United States Patent
Morganti et al.

(10) Patent No.: US 6,728,506 B2
(45) Date of Patent: Apr. 27, 2004

(54) WICK ROLLER FOR AN ELECTROPHOTOGRAPHIC MACHINE

(75) Inventors: Terry N. Morganti, Brockport, NY (US); James V. Orchard, II, Holley, NY (US); Richard C. Baughman, Geneseo, NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/144,580

(22) Filed: May 13, 2002

(65) Prior Publication Data

US 2003/0210935 A1 Nov. 13, 2003

(51) Int. Cl.[7] ..... G03G 15/20
(52) U.S. Cl. ..... 399/325
(58) Field of Search ..... 399/320, 324, 399/325; 118/DIG. 1

(56) References Cited

U.S. PATENT DOCUMENTS 4,908,670 A * 3/1990 Ndebi ..... 399/325
5,043,768 A * 8/1991 Baruch ..... 399/325
5,534,986 A * 7/1996 Irro et al. ..... 399/325
5,902,653 A * 5/1999 Miyahara et al. ..... 399/325 X
6,317,577 B1 * 11/2001 Baruch et al. ..... 399/325
6,480,694 B1 * 11/2002 Kimura et al. ..... 399/325

* cited by examiner

*Primary Examiner*—Sandra Brase

(57) ABSTRACT

A journal for forming the axle of a wick roller wherein the mounting section of the journal is provided with a nose section so that any adhesive which is skived from the core of the roller as the journal is positioned therein will collect on the nose section and will not foul the central bore through the core.

16 Claims, 3 Drawing Sheets

WICK ROLLER FOR AN ELECTROPHOTOGRAPHIC MACHINE

FIELD OF THE INVENTION

The present invention relates to a wick roller for use in the fuser section of a electrophotographic copier/printer machine and in one of its aspects relates to the journals, affixed in each end of a wick roller, for mounting the wick roller in the fuser section of an electrophotographic machine and the method of affixing said journals to the wick roller.

BACKGROUND OF THE INVENTION

In a typical electrophotographic machine (e.g. copier, duplicator, printer, etc.), a continuous loop of photoconductor film is commonly used to transfer an inputted image onto a receiving medium (e.g. a sheet of paper). The film is initially charged and the desired image is projected onto the charged film. Next, a toner is applied to the charged image and the toner image is then transferred onto the sheet of paper or other medium. The paper now passes through a fuser section where the toner is fixed to the paper by elevated temperature and pressure. This latter step is typically accomplished by passing the paper between a pressure roller and a fuser roller, one of which is heated.

Unfortunately, however, when the paper passes between the rollers, some of the heat-softened toner particles often adhere to the surface of the fuser roller, resulting in what is known as "offset". As is well understood in the art, toner offset can adversely affect the quality of the copies being made by the machine. A common way to alleviate "offset" is to apply a silicone oil (hereinafter referred to a "release oil") onto the fuser roller to prevent the toner from sticking thereto.

To apply the release oil onto the fuser roller, it is common to use a "wick roller". A typical wick roller is comprised of a cylindrical, permeable ceramic core covered with a layer of a high temperature, wicking material (e.g. felt or the like). The release oil is typically supplied through a thin, perforated conduit that, in turn, is positioned within an axial bore in the ceramic core whereby the oil is distributed evenly along the wick roller. The oil permeates through the ceramic core and into the wicking layer. The wick roller is periodically moved into and out of contact with the fuser roller so that the release oil is transferred to the fuser roller at timed intervals during the copying operation.

Since the wick roller has to serviced from time to time, it is important that the roller be easily removeable/replaceable. To facilitate this procedure, journals, which form the axle of the roller, are glued or otherwise affixed to each end of the ceramic core and the bearing surfaces on the journals are merely laid into open brackets that, in turn, are pivotably mounted in the fuser section. The loosely-mounted, wick roller only rotates when the brackets are moved to bring the wick roller into contact with the rotating fuser roller While this type of wick rollers can easily be removed for servicing, unfortunately, a relatively high number of these rollers have experienced early failure in the field. Investigations have revealed that most, if not all, of these early failures occur when the adhesive bond between the journals and the core fails and one or both of the journals break loose and separate from the ceramic core. It is believed that the failure in the adhesive bond is caused primarily by the alternating thermal stresses that occur during the heating and cooling cycles within the fuser section.

As will be appreciated by those who depend on electrophotographic machine(s) in their commercial operations, downtime and costs are a primary concern. Therefore, it can be seen that it is important to extend the operational life of any component, i.e. wick roller, wherever possible, so that the maintenance/service of that component is kept to a minimum.

SUMMARY OF THE INVENTION

The present invention provides a wick roller for use in a fuser section of an electrophotographic machine and a method for assembling same wherein the operational life of the wick roller is significantly increased. That is, the journals of the present invention, are significantly less likely to separate from the core of the roller during operation than were the journals used with this type of prior art, wick rollers.

Basically, the construction of the journals of the present invention allows adhesive to be applied both to a journal and to the core, itself, thereby providing a significantly better bond between the two. In known, prior art wick rollers, adhesive is not applied to the core but is applied only to the journal since it has been found that the journal will displace some of the adhesive off the core as the journal is moved into the core. This displaced adhesive will collect in the central bore of the core and can seriously interfere with the positioning of the oil-distribution tube therein.

More specifically, the present invention relates to a wick roller for use in the fuser section of an electrophotographic machine wherein the roller is comprised of an elongated, cylindrical core made of a permeable ceramic material. The core has a central, axially-extending bore therethrough adapted to receive an oil distribution tube for supplying a release oil to the wick roller. The core also has two, axially-extending, cylindrical chambers; one opening from either end of the core with each being adapted to receive a journal therein.

The journals of the present invention are preferably made of plastic and are of basically the same construction. Each journal has a small diameter, bearing surface and a larger diameter, axially-extending, mounting section. The diameter of the mounting section is substantially equal to the diameter of the chamber in which it is to be mounted so that there will be a minimum of clearance therebetween when assembled. An axially-extending, nose section is affixed to the leading edge of the mounting section; preferably formed integrally therewith. The diameter of the nose section is less than that of the mounting section whereby the nose section forms a reduced-diameter, cylindrical step which leads the mounting section into the chamber when the journal is moved into said core.

The reduced-diameter of the nose section provides a "catch space" for any adhesive that may be displaced (i.e. skived off) from the chamber wall as the journal is forced into the chamber. By allowing any displaced adhesive to collect onto this step, excess adhesive can be applied to both the journal and the chamber wall without the risk that some of the displaced adhesive will foul the central bore of the core.

The mounting section of each journal is provided with a plurality of axially-extending grooves that, in turn, define a plurality of axially-extending ribs. It is desirable to maximize, as far as possible, the number of ribs (e.g. 12) on each mounting section in order to increase the effective contact area between a journal and its respective chamber in the core. By applying adhesive to the outer arcuate surfaces of the ribs and filling the grooves with adhesive and also applying adhesive to the chamber wall, a superior bond can be effected between the journal and the chamber in the core once the journal has been assembled into the chamber and the adhesive has been allowed to set.

BRIEF DESCRIPTION OF THE DRAWINGS

The actual construction, operation, and apparent advantages of the present invention will be better understood by referring to the drawings, not necessarily to scale, in which like numerals identify like parts and in which.

While the invention will be described in connection with its preferred embodiments, it will be understood that this invention is not limited thereto. On the contrary, the invention is intended to cover all alternatives, modifications, and equivalents that may be included within the spirit and scope of the invention, as defined by the appended claims.

DESCRIPTION OF THE PREFERRED EMBODIMENTS

Figure 1:
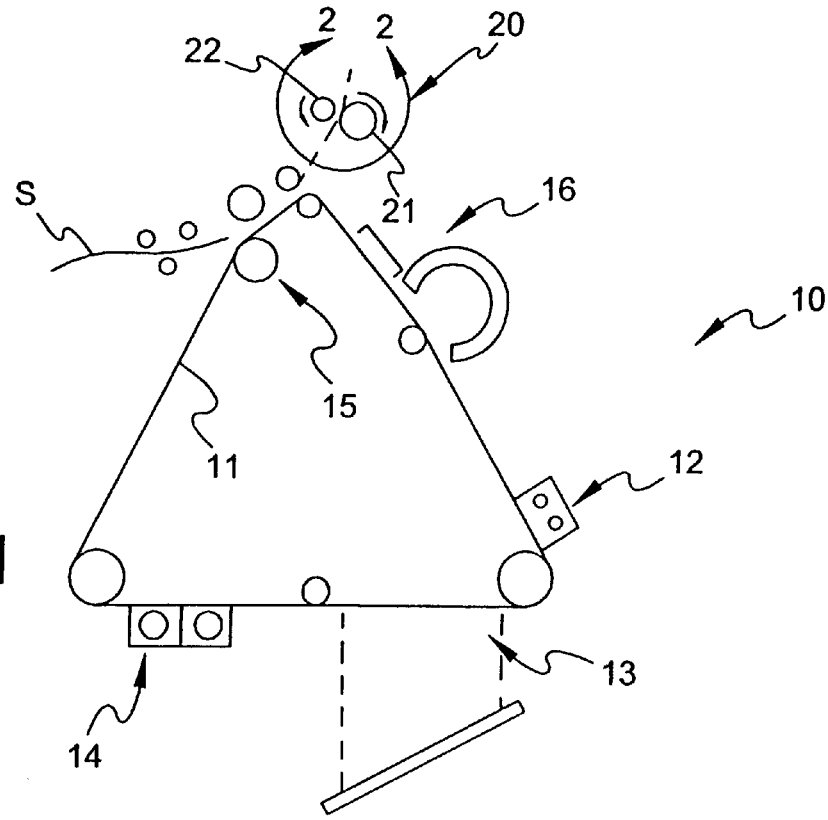
FIG. 1 is a schematic view of a typical electrophotographic apparatus (e.g. copier/printer machine)

Referring now to the drawings, FIG. 1 schematically illustrates a typical electrophotographic machine 10 (e.g. copier, duplicator, printer) of the type that uses an endless photoconductor belt 11 (e.g. photographic film) to transfer an image onto a copy medium (e.g. a sheet S of paper). As will be understood in the art, belt 11 moves through a closed loop past a charging station 12, an exposure or image input station 13, a developing station 14, a transfer station 15, and an erase/clean section 16. Toner is applied to a charged image on the film 11 in input station 13 and is then transferred to the sheet S as sheet S passes through transfer station 15. Sheet S is then fed between a fusing roller 21 and a pressure roller 22 in fuser section 20 to fix the toner image on the sheet before the sheet exits the machine 10.

Figure 2:
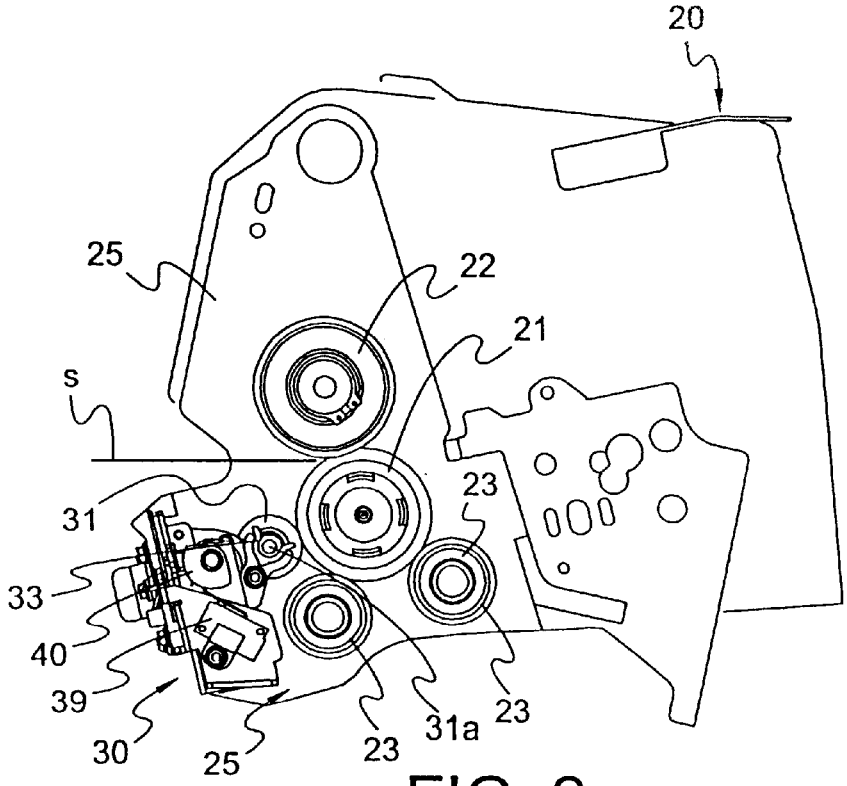
FIG. 2 is a cross-section view of a typical fuser section that would lie within line 2—2 of FIG. 1 and in which the wick roller of the present invention can be used.
Figure 3:
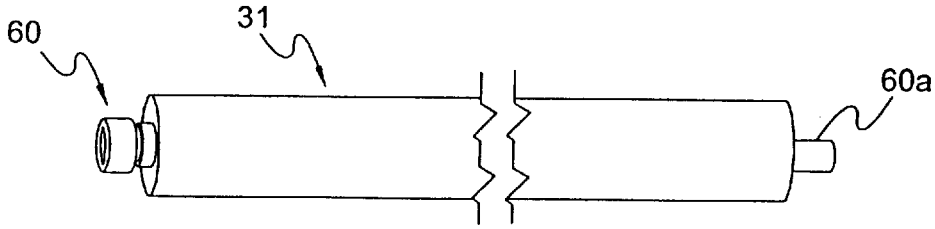
FIG. 3 is an enlarged, perspective view of the wick roller of the present invention when removed from the fuser section of FIG. 2.

FIG. 2 is a cross-sectional view of a typical fuser section 20 commonly used in electrophotographic machines of the type shown in FIG. 1. As illustrated, fuser section 20 is comprised of a housing 25 in which a pressure roller 22, a fuser roller 21, and two heating rollers 23 are rotatably mounted. Also, positioned within housing 25 is wick roller assembly 30 which will be described in more detail below.

As will be understood in the art, a motor (not shown) mounted on the housing 25 rotates pressure roller 22 which, in turn, rotates fuser roller 21 through the frictional contact therebetween. Fuser roller 21 is heated by heating rollers 23 so that when the sheet S passes between rollers 21, 22, the toner image will become fused on sheet S. Unfortunately, some of the toner particles on sheet S adhere to fuser roller 21 as the sheet passes between the rollers and this "toner offset" can adversely affect the quality of the copies being made unless remedies are taken to alleviate this problem.

One common remedy involves periodically applying a release oil (e.g. a silicone oil or the like) directly onto the fuser roller 21 during copying operations. This oil is typically applied through a wick roller assembly 30 of the type shown in FIG. 2. Briefly, wick roller assembly 30 is comprised of a frame 32 having a pair of pivoted brackets 33 therein, one at either side of frame 32. Journals 31*a* (only one end shown) are affixed to wick roller 31 at each end and effectively form an axle that rotates with the wick roller.

Journals 31*a* merely lay in their respective, open brackets 33 and are free to rotate with respect to the brackets. A motor (not shown), controlled by a cam (40)-operated switch 39, operates other cams (not shown) to move brackets 33 so that wick roller 31 is moved into and out of contact with fuser roller 21, as will be understood in the art. For further details of such a fuser section and wick roller assembly 30, see co-pending and commonly assigned U.S. patent application Ser. No. 09/745,861, filed Dec. 21, 2001, which is incorporated herein by reference.

Also as will be understood in the art, typical wick roller 31 is basically comprised of an elongated, cylindrical, permeable ceramic core 41 (FIG. 5) which has a layer or cover of wicking material 42 (e.g. fabric such as high temperature felt) positioned over its outer surface. Core 41 has a central, axially-extending bore 43 therethrough that is adapted to receive a perforated, oil distribution tube (not shown). This tube evenly distributes the release oil into and along the length of the bore 43 from which the oil then permeates through the core 41 and into the layer of wick material 42. A supply tube (not shown) supplies additional oil to the perforated tube as needed. When the wick roller 31 is moved into contact with the fuser roller 21, oil is transferred from the wicking material 42 onto the fuser roller as will be understood in the art.

The ceramic core 41 also has a pair of separate, axially-extending, cylindrical chambers 44; one opening from each end thereof (only one shown). Each chamber 44 is adapted to receive a respective journal 31*a* to effectively form an axle for the roller 31. The journals at each end of the wick roller are of the same basic construction except one of the journals (FIG. 4) has a central bore 45 (FIG. 6) all the way therethrough to allow the perforated, oil-distribution tube (not shown) to be positioned in the central bore 43 of core 41, as will be understood in the art.

Figure 5:
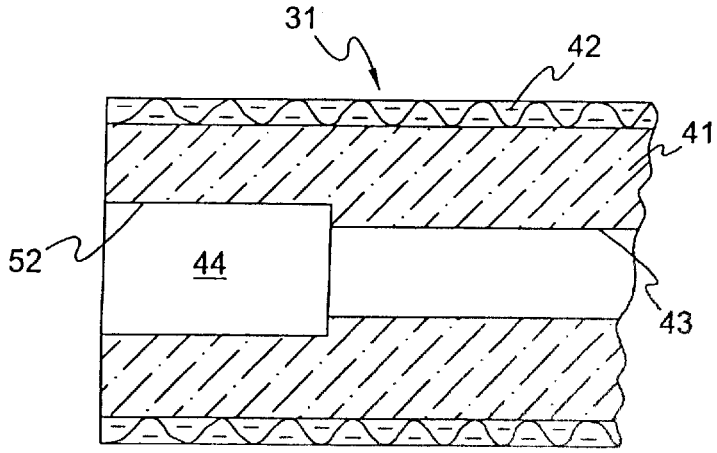
FIG. 5 (Prior Art)
FIG. 5 is a cross-sectional view of one end of a typical, wick roller into which the prior art journal of FIG. 4 can be fitted.
Figure 4:
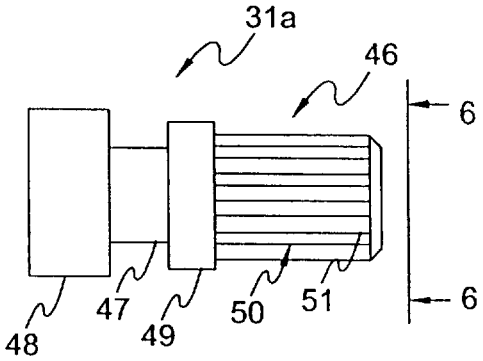
FIG. 4 (Prior Art)
FIG. 4 is a perspective view of a typical prior art journal for a wick roller.
Figure 6:
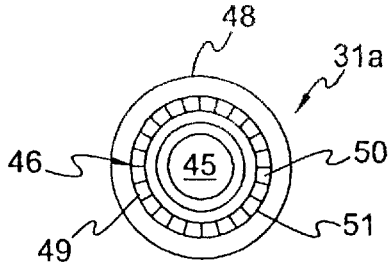
FIG. 6 (Prior Art)
FIG. 6 is an end view of the prior art journal of FIG. 4 taken along line 6—6 of FIG. 4.

A typical, prior art journal 31*a,* as shown in FIGS. 4–6, is comprised of a cylinder of strong plastic which has a cylindrical, mounting section 46 and a reduced-diameter, bearing surface 47 which, in turn, is adapted to loosely rest in bracket 33 (FIG. 1) when wick roller 31 is in an operable position within fuser section 20. Flanges 48, 49 are provided at each end of bearing surface 47 on at least one of the journals to prevent the wick roller 31 from moving laterally once positioned in bracket 33. The maximum diameter and the length of the mounting section 46 are sized so that substantially its entire length can fully enter into and be glued or otherwise secured within chamber 44 of core 41.

Section 46 is grooved along its length to provide a plurality of longitudinal ribs 50 (e.g. eight) which are radially-spaced about the surface thereof. The outer, surface 51 of each rib 50 provides the primary contact area between the ribs and the inner surface 52 of chamber 44. An adhesive (e.g. 3-M Scotchweld® 2214-High Temperature epoxy adhesive) is applied to surfaces 51 and into the grooves therebetween. The mounting section 46 of journal 31*a* is then moved into chamber 44 and the adhesive is allowed to set.

Unfortunately, in known prior art wick rollers of this type, the journals, such as just described, have experienced an undesirable, high incidence of failures in the field. Investigations have revealed several possible causes for these failures. First, due to the original clearance between the diameter of the mounting section 46 and the diameter of chamber 44 (e.g. 0.4 inches and 0.5 inches, respectively), an excessive amount of "slop" exists between the two when they are first assembled.

Second, the contact area between the areas 51 of the ribs 50 and inner surface 52 of chamber 44, which provides the primary adhesive bond therebetween, is insufficient to resist the alternating heating and cooling, thermal stresses which occur during operation. Also, the grooves between ribs 50 are too deep whereby these grooves may only be partially filled with the adhesive thereby further enhancing the possibility of failure of the glued connection between the journal 31*a* and the surface 52. All of these factors can lead to the loosening/separation of the journal during operation to the extent that the wick roller is no longer functional thereby significantly increasing the downtime and/or operating costs of machine 10.

Reference is now made to FIGS. 7–10, which illustrate journals 60, 60*a* of the present invention. Since both of these journals are of basically the same construction, only journal 60 will be described in detail; i.e. journal 60*a* differing from journal 60*a* only in that the center bore does not go all the way through journal 60*a* and the outermost flange 148 on journal 60 is not needed.

Figure 7:
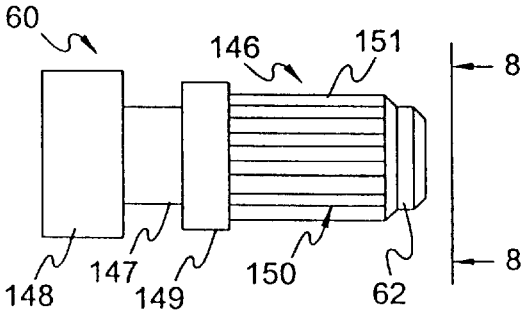
FIG. 7 is a perspective view of the journal of the present invention.
Figure 8:
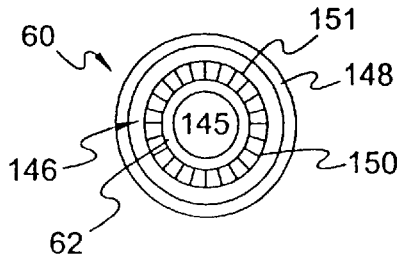
FIG. 8 is an end view of the journal of FIG. 7 taken along line 8—8 of FIG. 7.
Figure 9:
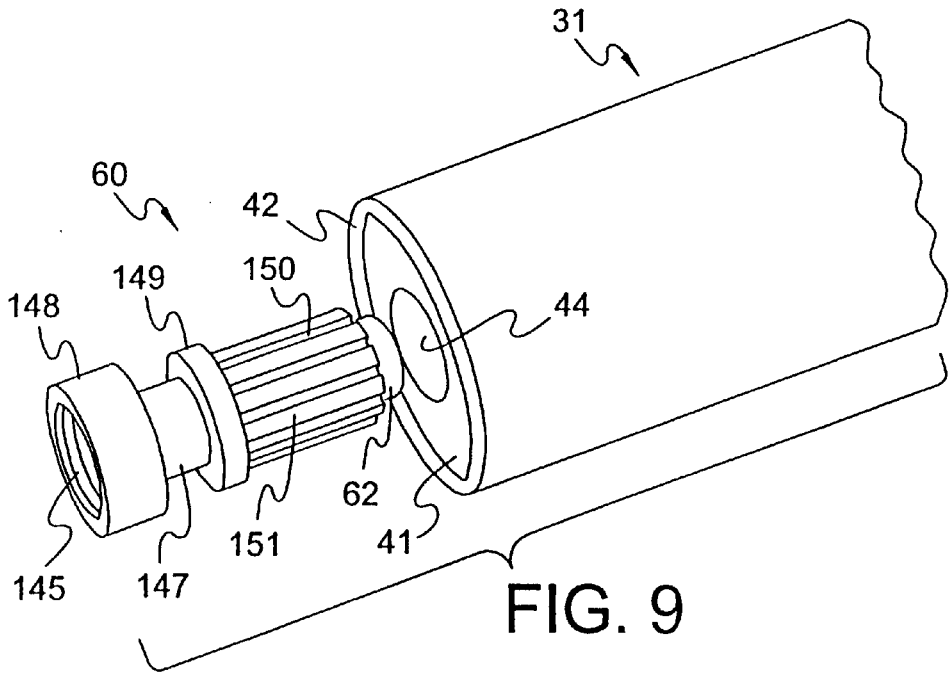
FIG. 9 is an enlarged, exploded view of one end of a wick roller of present invention with a one of the journals removed.
Figure 10:
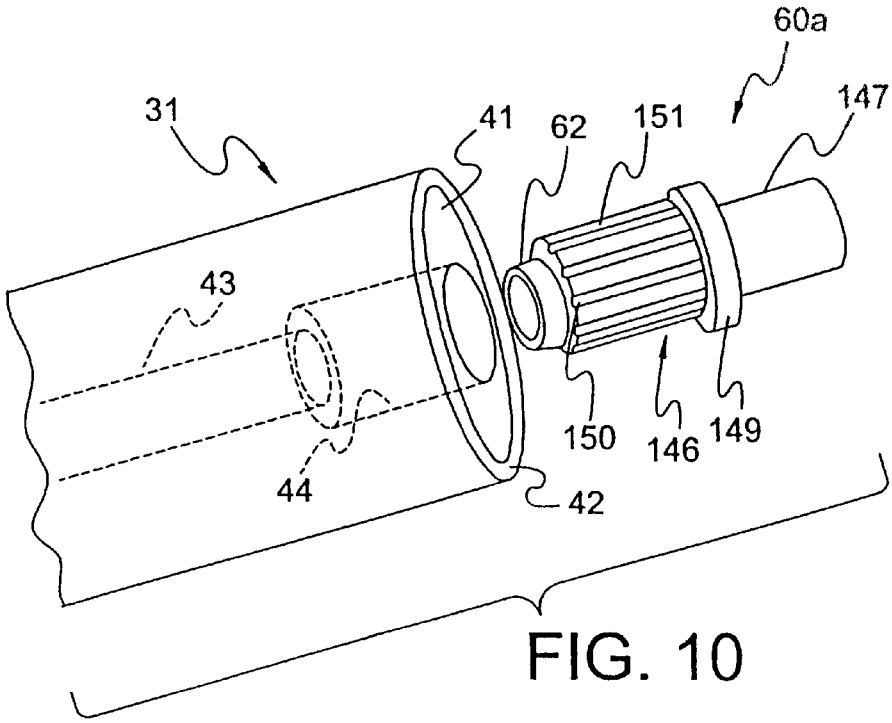
FIG. 10 is an enlarged, exploded view of the other end of the wick roller of FIG. 3 with the other journal removed.

As will be seen from comparing FIGS. 4 and 7, journal 60 (FIG. 7) is similar in several aspects to prior art journal 31*a* (FIG. 4). That is, both are cylindrical in shape and are preferably made of a strong plastic. Each has, respectively, a cylindrical mounting section (46 and 146); a reduced-diameter, bearing surface (47 and 147); spaced flanges (48, 49 and 148, 149), and a central bore (45 and 145), all of which serve the same basic functions. However, there are several major distinct differences between the two whereby the use of journal 60 of the present invention significantly extends the operational life of a typical wick roller over a roller using prior art journal 31*a*.

First, in accordance with the present invention, journal 60 allows adhesive to be applied, not only to the mounting section 146 of journal 60 (as is done in prior art applications), but also to be applied to the inner surface or wall 52 of chamber 44. This insures the filling of any voids that may exist between chamber wall 52 and mounting section 146 when the two are mated. As will be appreciated, this substantially strengthens the adhesive bond therebetween. Note, if additional adhesive is applied to the wall 52 of chamber 44 in the prior art applications, the leading edge of mounting section 46 of prior art journals 31*a* (FIG. 4) will scrape or displace some of the adhesive from the chamber wall as the journal advances into the chamber. This displaced adhesive collects in the bore 43 of ceramic core 41 and seriously interferes with the insertion and/or removal of the required oil distribution tube (not shown).

To allow adhesive to be applied to chamber wall 52 as well as to the journal, itself, without risking damage to bore 43, the journal 60 of the present invention has a cylindrical, nose section 62 that axially extends from the front or leading edge of mounting section 146. Preferably, nose section 62 is molded as an integral part of the journal 60. Journal 60 has a central bore 145 (FIG. 8) therethrough to allow the oil distribution tube to pass therethrough and into bore 43 of core 41 similarly as did prior art journal 31*a*.

Nose section 62 is stepped down in radius (e.g. ⅛ inch) from the radius of mounting section 146 and extends for a short distance (e.g. ⅛ inch) from the front of segment 146 to thereby form a leading "step" on the journal 60. The reduced-diameter of nose section or step 62 provides a "catch space" for any adhesive that may be displaced (i.e. skived off) from chamber wall 45 as journal 60 is moved into chamber 44. By allowing any displaced adhesive to collect onto step 62, excess adhesive can be applied without fouling bore 43.

Also, in accordance with the present invention, the overall effective diameter of mounting section 146 is increased (e.g. from 0.4 to approximately 0.5 inches) to substantially match the diameter of chamber 44 in core 41. That is, the diameter of mounting segment 146 is just small enough to allow it to be positioned in chamber 44. This substantially reduces the "slop" previously experienced in the prior art wick rollers and also eliminates the possibility of misalignment. Also, it increases the pressure fit between the core and the journal when the core thermally expands during operation thereby further effecting a good connection between the journal and the core.

Still further, the number of ribs 150 is increased (e.g. from 8 to 12) to provide more area 151, i.e. contact area, between the mounting segment 146 of journal 60 and chamber wall 52. At the same time, the depth of the grooves forming ribs 150 is reduced (e.g. from 0.031 to 0.017 inches) thereby providing less space that the adhesive has to fill which, in turn, also insures a better bonding between the journal and the core.

To mount journal 60 in chamber 44 of the ceramic core, adhesive is spread onto chamber wall 52 and is generously applied (i.e. "buttered") onto the mounting section 146 of journal 60 to cover the surfaces 151 of all of ribs 150 and to completely fill all of the grooves between the ribs. Journal 60 is then forced into chamber 44 until all of mounting section 146 lies within the chamber. The length of segment 146 is such that when the mounting section is completely within chamber 44, the front of step 62 will approach but not enter bore 43. Any adhesive that may be displaced by journal 60 will collect on step 62 and will not adversely affect bore 43.

It should be evident from the above that the present invention provides a journal that can be more securely bonded to the core of a wick roller thereby significantly increasing the operational life of the wick roller.

What is claimed is:

1. A wick roller for use in the fuser section of an electrophotographic machine, said wick roller comprising:

an elongated, cylindrical core having a first end and a second end and a central, axially-extending bore therethrough; said core having an axially-extending, cylindrical chamber having an inner diameter, said chamber opening from said first end of said core; and a journal adapted to be positioned in said chamber to form at least a part of an axle for said wick roller, said journal comprising:

an axially-extending, mounting section having a section outer diameter adapted to fit into said chamber of said core; and an axially-extending, nose section affixed to an inner end of said mounting section, said nose section having a diameter which is less than said section outer diameter of said mounting section whereby said nose section forms a reduced-diameter, cylindrical step at said inner end which extends into said chamber beyond said inner end of said mounting section when said journal is assembled into said core.

2. The wick roller of claim 1 wherein said journal has an axially-extending, central bore therethrough.

3. A wick roller for use in the fuser section of an electrophotographic machine, said wick roller comprising:

an elongated, cylindrical core having a first end and a second end and a central, axially-extending bore therethrough; said core having a first axially-extending, cylindrical chamber having a first inner diameter, said first chamber opening from said first end of said core; and a first journal adapted to be positioned into said first chamber to form at least a part of an axle for said wick roller, said journal comprising:

a first axially-extending, mounting section having an outer diameter adapted to fit into said first chamber of said core; and a first axially-extending, nose section affixed to one end of said first mounting section, said nose section having an outer diameter which is less that said outer diameter of said first mounting section whereby said nose section forms a reduced-diameter, cylindrical step at said one end which extends into said first chamber beyond an inner end of said first mounting section when said journal is positioned in said core;

a second axially-extending, cylindrical chamber having a diameter substantially equal to said first inner diameter, said second chamber opening from said second end of said core; and a second journal adapted to be positioned into said second chamber and which in combination with said first journal forms said axle for said wick roller, said second journal comprising:

a second axially-extending, mounting section having an outer diameter adapted to fit into said second chamber of said core; and a second axially-extending, nose section affixed to one end of said second mounting section, said nose section having a diameter which is less that said outer diameter of said second mounting section of said second journal whereby said nose section forms a reduced-diameter, cylindrical step on said second mounting section which extends into said second chamber beyond an inner end of said second mounting section when said second journal is assembled into said core.

4. The wick roller of claim 3 including:

adhesive applied to both said first and second chambers and to said first and second journals before said journals are assembled into respective said chambers to thereby affix said first and second journals in said respective first and second chambers in said core.

5. The wick roller of claim 3 wherein said core is comprised of a permeable ceramic and said first and second journals are comprised of plastic.

6. The wick roller of claim 5 wherein said outer diameter of said first mounting section of said first journal is substantially equal to the inner diameter of said first chamber and said outer diameter of said second mounting section of said second journal is substantially equal to the inner diameter of said second chamber.

7. The wick roller of claim 6 including:

a plurality of axially-extending grooves on said first mounting section of said first journal and said second mounting section of said second journal to thereby form a plurality of, axially-extending ribs on said first and second mounting sections.

8. The wick roller of claim 7 wherein each of said mounting sections of said first and second journal include at least 12 ribs.

9. The wick roller of claim 8 wherein said adhesive is applied to said ribs and fills said grooves on said first and second mounting sections before said journals are assembled into said chambers in said core.

10. The wick roller of claim 9 wherein said nose section is formed integral with said mounting section of a respective journal.

11. A journal for forming a part of an axle for a wick roller, said journal comprising:

an axially-extending, mounting section having a diameter adapted to fit into a chamber within said wick roller; and an axially-extending, nose section affixed to one end of said mounting section, said nose section having a diameter which is less than said diameter of said mounting section whereby said nose section forms a reduced-diameter, cylindrical step at said one end which is inserted first into said chamber when said journal is assembled into said core.

12. The journal of claim 11 including:

a bearing surface affixed to the other end of said mounting section.

13. The journal of claim 12 wherein said mounting section includes at least 12 ribs.

14. The journal of claim 11 including:

a plurality of axially-extending grooves on said mounting section to thereby form a plurality of axially-extending ribs on said mounting section of said journal.

15. A method of assembling a journal into a chamber within a core of a wick roller wherein said journal has a mounting section with a reduced-diameter, nose section affixed to the leading edge thereof, said method comprising:

applying an adhesive to the wall of said chamber;

applying an adhesive to said mounting section of said journal;

inserting said leading edge of said mounting section of said journal into said chamber;

collecting any adhesive that is displaced from said wall of said chamber onto said nose section as said mounting section is positioned within said chamber; and allowing said adhesive to set to bond said journal within said chamber.

16. The method of claim 15 including:

providing a plurality of axially-extending ribs with grooves therebetween on said mounting section of said journal; and applying said adhesive to said ribs and said grooves before said mounting section is inserted into said chamber.

* * * * *